US012742566B2

(12) United States Patent
Jenni et al.

(10) Patent No.: US 12,742,566 B2
(45) Date of Patent: Sep. 22, 2026

(54) HEATING, VENTILATING AND AIR CONDITIONING HVAC DEVICE BLOCK

(71) Applicant: BELIMO HOLDING AG, Hinwil (CH)

(72) Inventors: Stefan Jenni, Wattwil (CH); Silvio Grogg, Wetzikon (CH); Peter Schmidlin, Uster (CH)

(73) Assignee: BELIMO HOLDING AG, Hinwil (CH)

( * ) Notice: Subject to any disclaimer, the term of this patent is extended or adjusted under 35 U.S.C. 154(b) by 365 days.

(21) Appl. No.: 18/283,670

(22) PCT Filed: Mar. 31, 2022

(86) PCT No.: PCT/EP2022/058642
§ 371 (c)(1),
(2) Date: Sep. 22, 2023

(87) PCT Pub. No.: WO2022/207834
PCT Pub. Date: Oct. 6, 2022

(65) Prior Publication Data

US 2024/0167719 A1 May 23, 2024

(30) Foreign Application Priority Data

Mar. 31, 2021 (CH) ..... 00339/21
Apr. 30, 2021 (CH) ..... 00473/21
(Continued)

(51) Int. Cl.
*F24F 11/89* (2018.01)
*F24F 1/0043* (2019.01)
(Continued)

(52) U.S. Cl.
CPC ..... *F24F 11/89* (2018.01); *F24F 1/0043* (2019.02); *F24F 1/60* (2013.01); *F24F 11/56* (2018.01);
(Continued)

(58) Field of Classification Search
None
See application file for complete search history.

(56) References Cited

U.S. PATENT DOCUMENTS 10,261,530 B2 4/2019 Schmidlin et al.
10,317,101 B2 6/2019 Trikha et al.
(Continued)

FOREIGN PATENT DOCUMENTS

CH 707 624 A1 8/2014
CN 105324725 A 2/2016
(Continued)

OTHER PUBLICATIONS

Swiss Search Report of No. 00339/21 dated Jul. 15, 2021.
(Continued)

*Primary Examiner* — David Earl Ogg
(74) *Attorney, Agent, or Firm* — Sughrue Mion, PLLC

(57) ABSTRACT

A base HVAC device block (10) comprising a housing (11); an HVAC functional device (M/S); an extension interface (16A); an external electrical interface (18) for the transmission of electrical power and data signal(s); and an electronic circuit (12) connected with the HVAC functional device (M/S). In a first configuration, the base HVAC device block (10) is configured to connect the external electrical interface (18) with the electronic circuit (12) for transmission of data signal(s) and thereby provide HVAC functionality(s) of a first category. In a second configuration, the base HVAC device block (10) is configured to route the transmission of data signal(s) through an add-on electronic circuit (22) of an
(Continued)

add-on HVAC device block (20) attached to the base HVAC device block (10) via an add-on interface (26B) of the add-on HVAC device block (20) to thereby provide HVAC functionality(s) of a second category.

21 Claims, 9 Drawing Sheets

(30) Foreign Application Priority Data

May 14, 2021 (CH) ..... 00545/21
Mar. 14, 2022 (CH) ..... 000273/2022

(51) Int. Cl.

| | |
|---|---|
| ***F24F 1/60*** | (2011.01) |
| ***F24F 11/56*** | (2018.01) |
| ***F24F 11/88*** | (2018.01) |
| ***F24F 13/14*** | (2006.01) |
| ***F24F 13/20*** | (2006.01) |
| ***F24F 13/32*** | (2006.01) |

(52) U.S. Cl.
CPC ..... *F24F 11/88* (2018.01); *F24F 13/14* (2013.01); *F24F 13/20* (2013.01); *F24F 13/32* (2013.01); *F24F 2013/1433* (2013.01); *F24F 2221/36* (2013.01)

(56) References Cited

U.S. PATENT DOCUMENTS

| | | | | |
|---|---|---|---|---|
| 12,425,294 | B2 | 9/2025 | Gottschalk et al. | |
| 2010/0070234 | A1 | 3/2010 | Steinberg et al. | |
| 2012/0061480 | A1* | 3/2012 | Deligiannis | G05B 15/02 340/5.2 |
| 2014/0087661 | A1 | 3/2014 | Kim et al. | |
| 2014/0207290 | A1* | 7/2014 | Crawford | G05D 23/1917 700/276 |
| 2015/0362928 | A1 | 12/2015 | Schmidlin et al. | |
| 2017/0295058 | A1* | 10/2017 | Gottschalk | H04L 41/0803 |
| 2017/0336770 | A1* | 11/2017 | Macmillan | G05B 19/042 |
| 2018/0119972 | A1 | 5/2018 | Trikha et al. | |
| 2019/0199035 | A1 | 6/2019 | So et al. | |
| 2019/0203967 | A1* | 7/2019 | Grogg | H04Q 9/00 |
| 2019/0232210 | A1 | 8/2019 | Hur et al. | |
| 2020/0119982 | A1 | 4/2020 | Gottschalk et al. | |
| 2020/0363092 | A1* | 11/2020 | Kimata | F24F 11/88 |
| 2023/0066138 | A1 | 3/2023 | Gottschalk et al. | |

FOREIGN PATENT DOCUMENTS

| | | | |
|---|---|---|---|
| CN | 106500186 | A | 3/2017 |
| CN | 107314439 | A | 11/2017 |
| CN | 105757817 | B | 3/2019 |
| CN | 109417497 | A | 3/2019 |
| CN | 210320478 | U | 4/2020 |
| CN | 111156663 | A | 5/2020 |
| CN | 111237904 | A | 6/2020 |
| CN | 112367127 | A | 2/2021 |
| DE | 20 2019 100 593 | U1 | 2/2020 |
| EP | 3 668 064 | A1 | 6/2020 |
| EP | 3 706 427 | A1 | 9/2020 |
| JP | 11-325546 | A | 11/1999 |
| JP | 2004-263887 | A | 9/2004 |
| KR | 10-2020-0012332 | A | 2/2020 |
| KR | 10-2020-0012333 | A | 2/2020 |
| WO | 2018/080833 | A1 | 5/2018 |

OTHER PUBLICATIONS

Swiss Search Report of No. 00473/21 dated Sep. 21, 2021.
Swiss Search Report of No. 00545/21 dated Dec. 1, 2021.
International Search Report of PCT/EP2022/058642 dated Jul. 18, 2022 [PCT/ISA/210].
Written Opinion of PCT/EP2022/058642 dated Jul. 18, 2022 [PCT/ISA/237].
Liming et al., "A Study on the Expansion of Building Electrical Equipment Family Libraries Based on BIM Technology", Building Electrical, Apr. 2020, vol. 5, No. 2, pp. 71-73 (6 pages).
Communication dated Mar. 20, 2026, in Chinese Application No. 202280026248.8.

* cited by examiner

HEATING, VENTILATING AND AIR CONDITIONING HVAC DEVICE BLOCK

CROSS REFERENCE TO RELATED APPLICATIONS

This application is a National Stage of International Application No. PCT/EP2022/058642 filed on Mar. 31, 2022, claiming priority based on Swiss Patent Application No. 00339/21 filed on Mar. 31, 2021, Swiss Patent Application No. 00473/21 filed on Apr. 30, 2021, Swiss Patent Application No. 00545/21 filed on May 14, 2021, and Swiss Patent Application No. 000273/2022 filed on Mar. 14, 2022, the contents of each of the International Application and the four Swiss Applications being herein incorporated by reference in their entireties.

FIELD OF THE INVENTION

The present invention relates to a base Heating, Ventilating and Air Conditioning HVAC device block, an add-on HVAC device block and an HVAC field device comprising a base HVAC device block and an add-on HVAC device block. The present invention further relates to a method of operating a base HVAC device block.

BACKGROUND OF THE INVENTION

As people spend an estimated 90% of their time indoors, Heating, Ventilating and Air Conditioning HVAC systems have become of great importance to everyday life and have a great impact on people's health and comfort. In the field of Heating, Ventilating and Air Conditioning, HVAC systems typically comprise a fluid transportation system connected to a heat exchanger arranged such as to be able to transfer thermal energy to or from the environment to be controlled (referred to hereafter as controlled environment) by means of a fluid circulating in said fluid transportation system. In order to be able to regulate the flow of fluid to/from the heat exchanger and hence the amount of thermal energy transferred, the heat exchanger is connected to the fluid transportation system via one or more actuated parts, such as valves and dampers. Alternatively, or additionally the fluid transportation system of HVAC systems is configured to provide/extract a fluid, in particular a gaseous fluid such as air to or from the environment to be controlled. In order to be able to regulate the flow of fluid to/from the environment to be controlled, the source of such fluid is connected to the fluid transportation system via one or more actuated parts, such as valves and dampers. The actuated parts are mechanically controlled by HVAC actuators, including motorized HVAC actuators coupled to the actuated part. In the field of HVAC, HVAC actuators typically comprise an electric motor, coupled (through gears and/or other mechanical coupling) to the actuated part. HVAC actuators are electrically controlled by HVAC controllers, in particular an electronic circuit thereof. In addition, various sensors are used to measure environmental variables such as humidity, temperature, $CO_2$ or dust particle levels. Furthermore, HVAC sensors are used to determine operational parameters of various elements of an HVAC system, such as an actuated position of an actuated part, the operational state of an HVAC actuator.

HVAC systems commonly comprise an HVAC controller configured to generate control signal(s) for operating the HVAC actuator(s) and/or process signals from the HVAC sensors. In typical HVAC applications, the HVAC controller(s) generate the control signals for the HVAC actuators according to various control algorithms (e.g. with regards to differential pressure, room temperature, flow of energy, etc.) to thereby actuate the actuators, such as to open and close an orifice of a valve or damper to regulate the flow of fluid.

Certain control functions of HVAC systems may be performed from a remote server arranged remote from the controlled environment, the remote server comprising a computer program such as a Building Management System BSM to control and monitor a building's mechanical and electrical equipment. Furthermore, certain functions, in particular the commissioning and/or configuration of HVAC systems may be performed by means of portable devices, such as a general purpose mobile computing device (e.g. a smartphone) or a dedicated configuration tool.

In summary, devices of HVAC systems may be categorized into two categories by their location with respect to the controlled environment: remote devices (arranged remote from the controlled environment) and field devices (located within the controlled environment or mechanically connected, e.g. by the fluid transportation system, to the controlled environment). Field devices implement one or more electrical and/or mechanical functions and/or other functions (e.g. hydraulic, optical) and comprise—but not limited to—actuators, sensors, or a combination thereof.

With increasing complexity of HVAC systems, there is an ever increasing demand for a wide variety of field devices implementing various electrical and/or mechanical and/or thermal HVAC functions and/or other functions (e.g. hydraulic, optical). Even for the same function, a range of HVAC field devices are required to cover a wide array of use cases each characterized by different parameters. For example, for the mechanical function of actuating a valve or a damper, different variants of a certain type of HVAC actuator are required to cover a wide range of flow regulation by means of valves of different sizes, requiring different actuation forces (e.g. a torque ranging from 1 Nm up to 160 Nm or even more). Different variants of HVAC actuators are also required to cover different power supplies and also different actuation times.

Furthermore, the nature of the controlled environment also leads to varying demands on the HVAC field devices. For example, special variants of HVAC field devices are needed to be suitable for use in harsh environments. In addition, depending on the architecture of the HVAC system, various variants of HVAC field devices are needed to cover the different types of connectivity requirements.

Covering such a wide range of mechanical functions, electrical functions and suitable for such a wide range of environments, results in a very high number of HVAC field devices that need to be manufactured, serviced and maintained. Using known methods of manufacturing, satisfying such demand for a wide range of HVAC field devices is complex and therefore costly for manufacturers. In addition to complex and costly manufacturing, the function of known HVAC field devices is often difficult to expand or alter without having to exchange the entire HVAC field device.

In order to address the need to provide a wide range of HVAC devices in a large number of different configurations without having to manufacture a specific type of HVAC field device for each possible combination of functions and/or parameters, HVAC field devices are assembled from multiple HVAC device blocks, the HVAC device blocks fulfilling various HVAC functions, wherein the HVAC functionality of a base HVAC device block—comprising an HVAC functional device such as a motor or sensor—is extended by HVAC functionality provided by add-on HVAC device blocks.

However, there is an unmet need to provide HVAC device blocks specifically adapted such that both base HVAC blocks and add-on HVAC device blocks can be re-used flexibly, wherein base HVAC blocks and add-on HVAC device blocks can individually or collaboratively provide HVAC functionalities.

SUMMARY OF THE INVENTION

It is an object of embodiments disclosed herein to at least partially overcome the disadvantages of known HVAC field devices.

In particular, it is an object of embodiments disclosed herein to provide HVAC device blocks specifically adapted such that both base HVAC blocks and add-on HVAC device blocks can be re-used flexibly, wherein base HVAC blocks and add-on HVAC device blocks can individually or collaboratively provide HVAC functionalities.

The above-identified objectives are addressed according to the present disclosure by a base HVAC device block comprising a housing; an HVAC functional device; an extension interface; an external electrical interface arranged on the housing; and an electronic circuit.

According to embodiments of the present disclosure, the HVAC functional device comprises an electric motor arranged within the housing to drive an actuated part and/or a sensor. The sensor of the base HVAC device block is configured to measure a parameter of the HVAC system, in particular an environmental parameter, such as a temperature, humidity, particulate matter (PM) and/or $CO_2$ level of an environment controlled by the HVAC system. Alternatively, or additionally, the sensor of the base HVAC device block is provided to measure operational parameters of various components of the HVAC system such as an actuated position of the actuated part and/or the operational state of the HVAC field device and/or other parameters of the HVAC system, such as a flow rate or differential pressure at locations of a liquid through a fluid transportation system. The extension interface is arranged on the housing and provided to accommodate an add-on HVAC device block, in particular by stacking, by connecting to a counterpart add-on interface of the add-on HVAC device block. The external electrical interface, also arranged on the housing, is configured for the transmission of both electrical power and data signal(s). The electronic circuit is connected with the HVAC functional device, in particular to receive and/or transmit signals thereto respectively therefrom, thereby providing one or more HVAC functionality(s) of a first category.

According to embodiments of the present disclosure, providing HVAC functionality—by the electronic circuit of the base HVAC device block comprises generating signal(s) for controlling the HVAC functional device, in particular control signals to drive an electric motor mechanically connected to an actuated part, such as a valve or damper. The control signals may be digital signals but also analog signals, such as specific currents or voltages to drive an electric motor.

Alternatively, or additionally, providing HVAC functionality—by the electronic circuit of the base HVAC device block comprises processing signals generated by the HVAC functional device, in particular signals indicative of a parameter as measured by a sensor comprised by or communicatively connected to the HVAC functional device.

In order to supply electrical power, the external electrical interface is connected with the electronic circuit and with the extension interface for transmission of electrical power. The extension interface is further connected with the external electrical interface for transmission of data signal(s). According to embodiments disclosed herein, the transmission of data signal(s) between the extension interface and the external electrical interface is one- or bi-directional.

To accommodate different use cases, the base HVAC device block is configured to be operated in a first configuration or a second configuration. In the first configuration, also referred to as stand-alone configuration, the data signal(s) received/sent through the external electrical interface are processed by the base HVAC device block, namely by its electronic circuit. For this purpose, in the first configuration, the HVAC device block is configured to connect the external electrical interface with the electronic circuit of the base HVAC device block for transmission of data signal(s).

On the other hand, in the second configuration, the data signal(s) received/sent through the external electrical interface are processed by an add-on HVAC device block attached to the base HVAC device block, in particular by an electronic circuit thereof. For this purpose, in the second configuration, the HVAC device block is configured to connect the external electrical interface with the electronic circuit of the base HVAC device block for transmission of data signal(s) through an add-on electronic circuit of an add-on HVAC device block attached to the base HVAC device block. The routing of the data signal(s) through the add-on electronic circuit of the add-on HVAC device block is accomplished via an add-on interface of the add-on HVAC device block, corresponding to and connected to the extension interface of the base HVAC device block. The add-on electronic circuit of the add-on HVAC device block is configured to provide HVAC functionality(s) of a second category. The second category of HVAC functionalities comprises at least one HVAC functionality not comprised by the first category of HVAC functionalities.

The present disclosure is advantageous as the base HVAC device block can be flexibly deployed by itself for fulfilling HVAC functionalities of the first category its functionalities being extendible to comprise HVAC functionalities of the second category by attaching an add-on HVAC device block, in particular by stacking. Furthermore, the add-on HVAC device block—providing HVAC functionality(s) of the second category—can be deployed with various base HVAC device blocks depending on the specific use case. These advantageous effects greatly improve the versatility of the HVAC device blocks while reducing the number of HVAC field devices that need to be manufactured to cover a wide spectrum of use cases.

According to embodiments of the present disclosure, providing HVAC functionality—by the add-on electronic circuit of the add-on HVAC device block comprises generating signal(s) for controlling the HVAC functional device, in particular control signals to drive an electric motor mechanically connected to an actuated part, such as a valve or damper. The control signals may be digital signals but also analog signals, such as specific currents or voltages to drive an electric motor.

Alternatively, or additionally, providing HVAC functionality—by the add-on electronic circuit of the add-on HVAC device block comprises processing signals generated by the HVAC functional device, in particular signals indicative of a parameter as measured by a sensor comprised by or communicatively connected to the HVAC functional device.

The present disclosure is advantageous since depending on the use case, generating signal(s) for controlling the HVAC functional device and/or processing signals generated by the HVAC functional device can be done by either the electronic circuit of the base HVAC device block, the electronic circuit of the add-on HVAC device block, or by both in two stages. Thereby, the electronic circuit of the base HVAC device block, the electronic circuit of the add-on HVAC device block can not only be used alternatively, but can also complement each other.

According to embodiments disclosed herein, the power and data transmission are separated, each being carried by dedicated connectors. In particular, the external electrical interface and the extension interface of the base HVAC device block comprise signal connector(s) for the transmission of data signals and power connector(s) for the transmission of electrical power. In order to supply it with electricity, the electronic circuit is connected with the power connector(s) of the external electrical interface. In order to power an attached add-on HVAC device block, the power connector(s) of the extension interface of the base HVAC device block are connected with the power connector(s) of its external electrical interface.

In order to route the data signals (to/from the electronic circuit of the base HVAC device block) through the add-on electronic circuit, the signal connector(s) of the external electrical interface are connected to both the signal connector(s) of the extension interface and the electronic circuit of the base HVAC device block.

In order to switch the base HVAC device block between the first and second operating modes (corresponding to stand-alone respectively extended operation), according to embodiments disclosed herein, a switching device is provided for switching between the first configuration and the second configuration. In particular, the switching device is configured to switch the base HVAC device block into the second configuration upon an add-on HVAC device block being attached to the base HVAC device block and/or to switch the HVAC device block into the first configuration upon an add-on HVAC device block being detached from the base HVAC device block.

In a first embodiment, the switching device comprises an electromechanical switch arranged such that signal connector(s) of the extension interface of the base HVAC device block are directly connected (bridged) with electrical connections leading to the electronic circuit of the base HVAC device block when no add-on HVAC device block is attached. Upon an add-on HVAC device block being attached, the electromechanical switch opens and the data signals are routed through the add-on HVAC device block, in particular via its add-on electronic circuit. In further embodiments, the switching device comprises electric bridges (or jumpers) or so-called dip switches connecting respective pairs of electrical pins of the extension interface. In an even further embodiment, the switching device comprises a configuration interface, such as a wired or wireless communication interface configured to receive configuration data indicative of the first or second configuration into which the base HVAC device block is to be switched to. For example, data indicative of operation in the first or second configuration is written into an NFC module arranged on or within the housing of the base HVAC device block.

The present disclosure further relates to an add-on HVAC device block comprising a housing; an add-on interface; and an add-on electronic circuit connected with the add-on interface. The add-on HVAC device block is configured to be attached—in particular by stacking—to a base HVAC device block according to one of the embodiments disclosed herein. In particular, the add-on interface is arranged on the housing such that it connects with the extension interface of the base HVAC device block when the add-on HVAC device block is attached to the base HVAC device block.

The add-on electronic circuit is configured to provide HVAC functionality(s) of a second category. In particular, the add-on electronic circuit provides data signal processing capabilities not supported by the electronic circuit of the base HVAC device block. According to embodiments disclosed herein, HVAC functionality(s) of the second category comprise processing of data signal(s) according to communication protocols not supported by the electronic circuit of the base HVAC device block. For example, while the electronic circuit of the base HVAC device block only supports analog communication protocols, the add-on electronic circuit is configured to further support digital communication protocols (e.g. RS485, KNX, MP-Bus, I2C). In particular, the add-on electronic circuit is configured to convert data signals (received/transmitted via the external electrical interface) between digital communication protocols and analog communication protocols supported by the electronic circuit of the base HVAC device block.

The add-on HVAC device block is configured, when attached to the base HVAC device block, to connect the external electrical interface with an electronic circuit thereof for transmission of data signal(s) through the add-on electronic circuit, via the add-on interface and the extension interface of the base HVAC device block.

By re-routing data signals between the external electrical interface and the electronic circuit of the base HVAC device block through the add-on electronic circuit of the add-on HVAC device block, the add-on electronic circuit extends the HVAC functionalities of the base HVAC device block with HVAC functionality(s) of second category, in particular by generating signal(s) for controlling the HVAC functional device and/or by processing signals generated by the HVAC functional device.

According to embodiments of the present disclosure, the add-on electronic circuit is connected with the add-on interface also for the transmission of electrical power. In other words, the add-on electronic circuit is powered by the base HVAC device block, via the extension interface and the add-on interface.

According to embodiments of the present disclosure, the HVAC functionality is provided by the electronic circuit (of the base HVAC device block and/or the add-on HVAC device block) by an application specific integrated circuit ASIC or a uC (microcontroller) (pre)configured for the particular HVAC functionality(s).

Alternatively, or additionally, the HVAC functionality is provided by the electronic circuit (of the base HVAC device block and/or the add-on HVAC device block) using computer readable instructions executable by a processor of the electronic circuit and/or of the add-on electronic circuit, for example a fully configurable uC (microcontroller).

In order to enable the extension of the HVAC functionalities of a base HVAC device block by HVAC functionalities of more than one add-on HVAC device blocks, without limitations posed by the number of connection interfaces that can be accommodated directly by the base HVAC device block, according to embodiments disclosed herein, the add-on HVAC device block further comprises a second add-on interface arranged on the housing. The second add-on interface is connected with the add-on interface for the transmission of electrical power and data signal(s), wherein the second add-on interface is configured to be able to receive the add-on interface(s) of one or more further add-on HVAC device block(s).

By providing the add-on HVAC device blocks with a second add-on interface, the add-on HVAC device blocks can be stacked directly onto the base HVAC device block or onto an add-on HVAC device block. Thereby, each add-on HVAC device block further extends the possibility of stacking another add-on HVAC device block, the add-on interface serving the purpose of connecting the add-on HVAC device block while the second add-on interface serving the purpose of receiving a further HVAC device block. Hence, there is effectively no limit to the number of add-on HVAC device blocks that can be stacked with a base HVAC device block to form an HVAC field device. By eliminating the limit on the number of HVAC device blocks that can be combined with a base HVAC device block, as is the case with prior art methods/prior art HVAC field devices, the complexity of each individual add-on HVAC device block can be reduced, allowing a dedicated add-on HVAC device block to be provided for each particular HVAC function. This in turn enables a higher degree of reuse of HVAC device blocks between different HVAC field devices, reducing costs of manufacturing, maintenance and increasing flexibility in providing new functionalities.

Furthermore, by eliminating the limit on the number of HVAC device blocks that can be combined with a base HVAC device block, as is the case with prior art methods/prior art HVAC field devices, there is no need to compromise with respect to the function provided by an HVAC field device. In other words, such embodiments of the present disclosure are advantageous since the flexibility of providing as many add-on HVAC device blocks as need ensures that as many functions are fitted to the HVAC field device as required but not more than necessary.

A further advantage of the present disclosure is that, since an unlimited number of HVAC device blocks can be combined using a single connection interface and only a pair of interfaces on the base HVAC device block and add-on HVAC device blocks, respectively, the space available for the connection interfaces is not reduced by increasing the number of add-ons—as would be the case in prior art solutions. According to embodiments of the present disclosure, essentially entire sides (e.g. top and bottom sides) of the housing of the HVAC device blocks are taken up by the connection interfaces, which allows a rigid mechanical connection between the HVAC device blocks after stacking, yielding a robust HVAC field device, while keeping the number of stackable HVAC device blocks open.

According to embodiments disclosed herein, the interfaces are configured such as to align adjacent HVAC device blocks upon the HVAC device blocks being stacked. For a better aligning effect, according to embodiments, the interface(s) are tapered at their outer surfaces.

According to embodiments of the present disclosure, the interfaces comprise a recess, in particular a circumferential recess arranged on a first side of the housing of the respective HVAC device block respectively a corresponding (mating) protrusion, in particular a circumferential protrusion arranged on a second side of the housing of the respective HVAC device block.

According to embodiments disclosed herein, the interface(s) are configured to mutually interlock by an interface-fit upon the HVAC device blocks being stacked to thereby fixedly attach the plurality of HVAC device blocks to each other. The term fixedly attaching, as used herein, refers to attaching such that a release force is required to separate the fixedly attached HVAC device blocks, the release force exceeding forces applied to the HVAC device blocks under normal operation of the HVAC field device and/or the release force acting in a direction/manner different from forces applied on the HVAC device blocks under normal operation of the HVAC field device.

According to even further embodiments, an adhesive and/or fastening means is provided to the interfaces for fixedly attaching the plurality of HVAC device blocks to each other upon being stacked. According to embodiments of the present disclosure, the fastening means comprise latches, screws or bolts in order to mechanically connect the adjacent HVAC device blocks.

Alternatively, or additionally, the HVAC device blocks are welded together after being stacked, in particular by ultrasonic welding or laser welding.

According to the specific requirements on the HVAC field device, a sealant is provided at the interfaces to seal the HVAC device blocks together, with respect to humidity, dust or other sources of contamination.

In order to provide additional or redundant power supply, embodiments of the add-on HVAC device block further comprise an add-on external electrical interface arranged on the housing for the transmission of electrical power, the add-on external electrical interface being connected to the add-on electronic circuit.

In order to provide additional or redundant data signal connectivity, embodiments of the add-on HVAC device block further comprise an add-on external electrical interface arranged on the housing for the transmission of data signal(s), the add-on external electrical interface being connected to the add-on electronic circuit.

It is an objective of further embodiments to extend the HVAC functionalities of a base HVAC device block so that data signal(s) and transmission of electrical power share the same electrical connections (Power-line communication PLC). This further objective is addressed in that the add-on interface of the add-on HVAC device block is configured for transmission of data signal(s) and transmission of electrical power over same electrical connections, the add-on HVAC device block further comprising a power supply unit. The power supply unit of the add-on HVAC device block is configured to transfer data signal(s) between the add-on interface and the add-on electronic circuit and to transfer electrical power from the add-on interface to the add-on electronic circuit. In particular, the transfer of data signal(s) between the add-on interface and the add-on electronic circuit by the power supply unit comprises demodulation of data signal(s) carried by power-line connections/modulation of data signal(s) to be then carried by power-line connections. The data signals being modulated/demodulated by the power supply unit of the add-on HVAC device block, the HVAC device blocks (both base and add-on) can provide the respective HVAC functionalities as if the transmission of data signal(s) and transmission of electrical power would be on dedicated connections.

It is an object of further embodiments of the present disclosure to enable a plug-and-play manufacture/assembly of HVAC device blocks into an HVAC field device. This further object is addressed according to the present disclosure by implementing an exchange of configuration data between the HVAC device blocks. Configuration data is stored in the electronic circuit of a first of the plurality of HVAC device blocks while its electronic circuit is configured to transmit configuration data through the extension interface of the first of the plurality of HVAC device blocks. Furthermore, the electronic circuit of a second of the plurality of HVAC device blocks, different from the first of the plurality of HVAC device blocks, is configured to receive configuration data through its add-on interface. The configuration data is transferred from the first of the plurality of stacked HVAC device blocks to the second and further HVAC device blocks for example upon the HVAC field device being supplied with electrical power. Alternatively, or additionally, the HVAC device blocks are configured such as to exchange configuration data upon the HVAC device blocks being stacked. Alternatively, or additionally, the HVAC device blocks are configured such as to exchange configuration data upon receipt of a command, e.g. as a data signal received via the external electrical interface.

Exchanging configuration data between the HVAC device blocks is advantageous since it allows the HVAC device blocks of an HVAC field device to be automatically configured. In case of HVAC field devices comprising more than two HVAC device blocks, the configuration data from one HVAC device block can be transferred even to not directly adjacent HVAC device blocks by means of step by step propagation between adjacent HVAC device blocks. Also, according to embodiments disclosed herein, the transfer, respectively receipt of configuration data is reciprocal, namely in that each HVAC device block is configured to both transmit and receive configuration data.

According to embodiments disclosed herein, the one or more add-on HVAC device block(s) comprise one or more of:

- A processing device, such as a microcontroller or application specific integrated circuit ASIC for providing computing power to the HVAC field device;
- A controller device, implementing HVAC control functions, such as a proportional P, a proportional-integral PI, a proportional-integral-derivative PID, an integral I and/or a neural network based control;
- A communication device, comprising a wired communication interface and/or a radio communication device—for providing communication functionalities to the HVAC field device. In particular, the communication device comprises one or more of:
  - A wired communication interface (such as an Ethernet, in particular a Power over Ethernet PoE, Single Pair Ethernet SPE, a BUS, in particular an MP Bus, BACnet, KNX or Modbus interface);
  - A Wide Area Network communication circuit (such as GSM, LTE, 3G, 4G or 5G mobile communications circuit);
  - A Low Power Wide Area Network (such as Narrowband Internet of Things NB-IoT, Long Range LoRa/LoRaWAN, SigFox, or Long Term Evolution Category M1 LTECatM1);
  - A local area network communication circuit (such as Wireless LAN);
  - A short range wireless communication circuit (such as Bluetooth, Bluetooth low energy BLE, Ultra-wideband UWB, Thread and/or Zigbee); and/or
  - A close-range wireless communication circuit (such as Radio Frequency Identification RFID or a Near Field Communication NFC).
- An energy storage device, comprising a capacitive storage device and/or an electro-chemical storage device;
- A sensor device, comprising one or more sensors for the measurement of a parameter of an HVAC system and/or of an environmental parameter (such as temperature, humidity, etc.);
- An HVAC interface device, comprising a mechanical interface to a damper and/or pipe of an HVAC system;
- A position feedback device of the actuated part;
- An electrical power supply device, for providing external electrical power to the HVAC field device, such as universal power supply devices (24 VAC to 250 VAC/24 VDC-125 VDC), or power supply devices for specific supply voltages;
- A monitoring/service device, for performing specific service and data logging function(s); and/or
- A display device.

Add-on HVAC device blocks according to embodiments disclosed herein may be grouped into several levels:

- Level 1 HVAC device blocks comprise an application specific integrated circuit ASIC, specifically designed for basic actuator functions, such as opening or closing a valve or damper. Furthermore, Level 1 HVAC device blocks comprise a communication Bus that allows a seamless integration to Level 2 device block(s);
- Level 2 HVAC device blocks comprise a uC (microcontroller) (pre)configured for application-specific extension of the functionality of the base HVAC device block, such as for executing a program code of at least a specific HVAC application, such as Variable Air Volume VAV control based on data signals from a sensor for the measurement of an air flow. Furthermore, Level 2 HVAC device blocks support various communication protocols such as ModBus or BACnet on different physical layers such as RS485, Ethernet, in particular Power over Ethernet PoE and/or Single Pair Ethernet SPE;
- Level 3 HVAC device blocks comprise a uC (microcontroller) fully configurable for advanced HVAC functions and/or similar functionality as the Level 2 HVAC device blocks.

According to embodiments of the present disclosure, the add-on HVAC device block extends the functionality of the base HVAC device block with the capability of being powered through the add-on HVAC device block. In order to provide this HVAC functionality, the add-on HVAC device block comprises a power interface and a power converter. The power interface is configured for being connectable to a power supply. The power converter is configured for transmitting electrical power from the power interface to the add-on HVAC device block and/or the base HVAC device block.

In particular, according to a further embodiment, the add-on HVAC device block extends the functionality of the base HVAC device block with the capability of being powered by an AC power supply, such as mains power supply of 230V. In order to provide this HVAC functionality, the power interface of the add-on HVAC device block is an AC interface for connecting an AC power supply, such as a 230V power supply connected to an AC/DC power converter. The AC/DC power converter of the add-on HVAC device block is configured to convert the AC power supplied through the AC interface to a low voltage DC power (such as 24V) and provide such low voltage DC power to the HVAC device blocks, in particular to the electric circuit of the base HVAC device block and the electronic circuit of the add-on HVAC device block. Such embodiment is advantageous since the other HVAC device blocks (other than the add-on HVAC device block having the AC power interface) do not have to be provided with the protective measures required for AC power supply (such as more robust wiring and/or insulation).

Alternatively, or additionally, the add-on HVAC device block extends the functionality of the base HVAC device block with the capability of being powered by a power over Ethernet connection. In order to provide this HVAC functionality, the power interface of the add-on HVAC device block is a power over Ethernet interface. The power converter of the add-on HVAC device block is a power over Ethernet converter, configured to transfer electrical power supplied through the power over Ethernet interface to the electric circuit of the base HVAC device block and the electronic circuit of the add-on HVAC device block.

The present disclosure further relates to an HVAC field device comprising a base HVAC device block, according to one of the embodiments disclosed herein, and an add-on HVAC device block according to one of the embodiments disclosed herein, the add-on HVAC device block being attached to the base HVAC device block so that the add-on interface is connected with the extension interface for transmission of electrical power and data signal(s).

The present disclosure further relates to a method of operating a base HVAC device block according to one of the embodiments disclosed herein. In a step of the method, HVAC functionality(s) of a first category is provided using the HVAC functional device by operating the base HVAC device block in a first configuration comprising connecting the electronic circuit with the external electrical interface for transmission of data signal(s). In a further step of the method, HVAC functionality(s) of a second category is provided using the HVAC functional device by operating the base HVAC device block in a second configuration. Operating the base HVAC device block in a second configuration comprises attaching an add-on HVAC device block to the base HVAC device block so that an add-on interface of the add-on HVAC device block is connected with the extension interface of the base HVAC device block for transmission of electrical power and data signal(s). Operating the base HVAC device block in the second configuration comprises connecting the external electrical interface with the electronic circuit for transmission of data signal(s) through the add-on electronic circuit of the add-on HVAC device block, via the extension interface and the add-on interface.

According to further embodiments disclosed herein, the method of operating a base HVAC device block further comprises connecting the electronic circuit and power connector(s) of the extension interface with power connector(s) of the external electrical interface for transmission of electrical power; and connecting the electronic circuit and signal connector(s) of the extension interface with signal connector(s) of the external electrical interface for the transmission of data signal(s).

According to further embodiments disclosed herein, the method of operating a base HVAC device block further comprises driving an actuated part using an electric motor of the HVAC functional device arranged within the housing according to signal(s) generated by the electronic circuit of the base HVAC device block and/or by the add-on electronic circuit of the add-on HVAC device block attached to the base HVAC device block. According to further embodiments disclosed herein, the method of operating a base HVAC device block further comprises processing, by the electronic circuit of the base HVAC device block and/or by the add-on electronic circuit of the add-on HVAC device block attached to the base HVAC device block, signal(s) indicative of a parameter of an HVAC system measured by a sensor of the HVAC functional device.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

The herein described disclosure will be more fully understood from the detailed description given herein below and the accompanying drawings which should not be considered limiting to the disclosure described in the appended claims. The drawings which show:

DETAILED DESCRIPTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
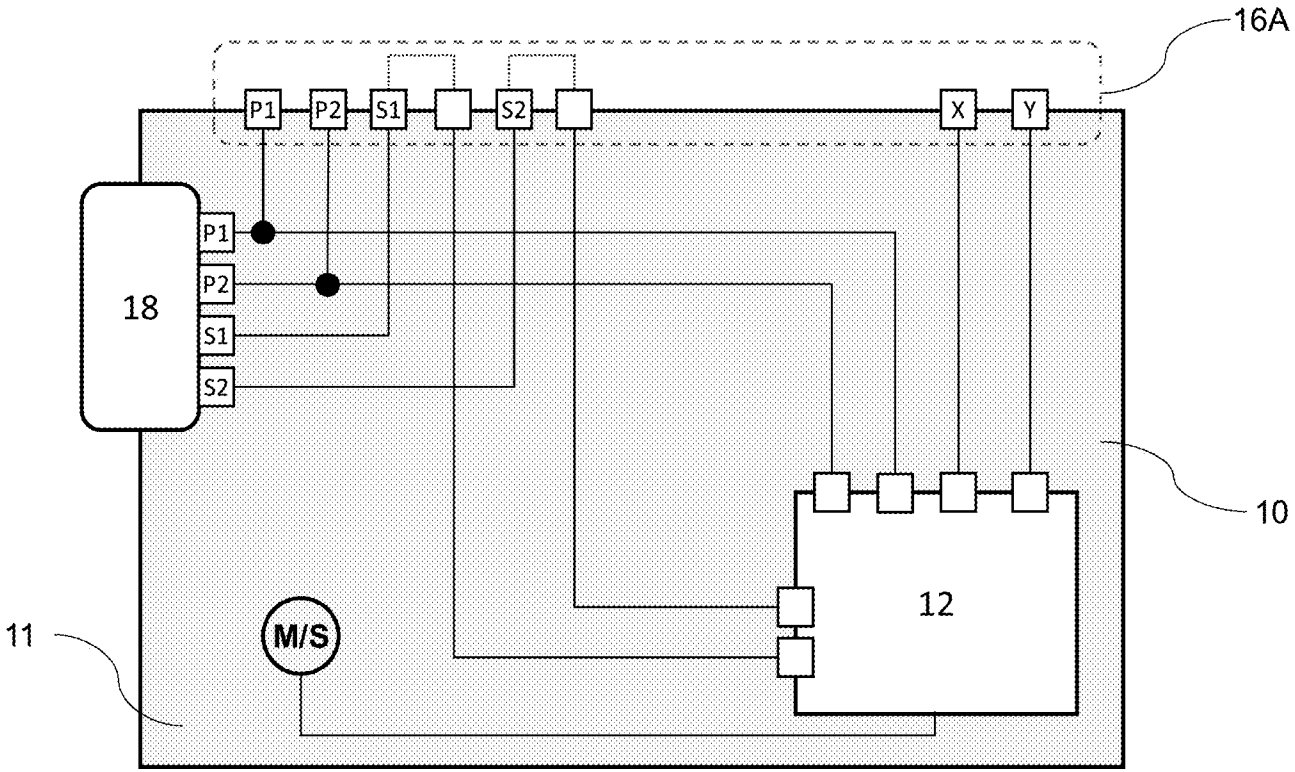
FIG. 1: a highly schematic block diagram of an embodiment of the base HVAC device block according to the present disclosure.

FIG. 1 shows a highly schematic block diagram of an embodiment of the base HVAC device block 10 according to the present disclosure. As shown on the figure, the base HVAC device block 10 comprises a housing 11; an HVAC functional device M/S; an extension interface 16A; an external electrical interface 18 arranged on the housing 11; and an electronic circuit 12.

The HVAC functional device M/S comprises an electric motor M arranged within the housing 11 to drive an actuated part 80 (located outside the housing 11) and/or a sensor S.

The sensor S is arranged within the housing 11. Alternatively, or additionally, the sensor S is arranged outside the housing 11 and communicatively connected to the base HVAC device block 10. The sensor S of the base HVAC device block 10 is configured to measure a parameter of the HVAC system, in particular an environmental parameter, such as a temperature, humidity, particulate matter PM and/or $CO_2$ level of an environment controlled by the HVAC system. Alternatively, or additionally, the sensor S of the base HVAC device block is provided to measure operational parameters of various components of the HVAC system 100 such as an actuated position of the actuated part 80 and/or the operational state of the HVAC field device 1 and/or other parameters of the HVAC system 100 (see FIG. 9), such as a flow rate or differential pressure at locations of a liquid through a fluid transportation system. The extension interface 16A is arranged on the housing 11 and provided to accommodate an add-on HVAC device block 20 (see FIGS. 2 and 3), in particular by stacking, by connecting to a counterpart add-on interface of the add-on HVAC device block. The external electrical interface 18, also arranged on the housing 11, is configured for the transmission of both electrical power and data signal(s). The electronic circuit 12 is connected with the HVAC functional device M/S, in particular to receive and/or transmit signals thereto respectively therefrom, thereby providing one or more HVAC functionality(s) of a first category.

According to the embodiment shown on the FIGS. 1 to 6, the external electrical interface 18 and the extension interface 16A of the base HVAC device block 10 each comprise signal connectors S1, Sn for the transmission of data signals and power connectors P1, Pn for the transmission of electrical power. In order to supply it with electricity, the electronic circuit 12 is connected with the power connectors P1, Pn of the external electrical interface 18. In order to power an attached add-on HVAC device block 20, the power connectors P1, Pn of the extension interface 16A are connected with the power connector(s) P1, Pn of its external electrical interface 18.

In the first configuration, also referred to as stand-alone configuration, the data signal(s) received/sent through the signal connectors S1, Sn of the external electrical interface 18 are processed by the base HVAC device block 10, specifically by its electronic circuit 12. For this purpose, in the first configuration, (illustrated in the figures with fine dotted lines), the HVAC device block 10 is configured to connect the signal connectors S1, Sn of the external electrical interface 18 with the electronic circuit 12.

The extension interface 16A further comprises further signal connectors X, Y for operation in the second configuration, wherein data signals are routed via an electronic circuit 22 of an add-on HVAC device block 20. The second configuration shall be described below with reference to FIGS. 4 and 5.

Figure 2:
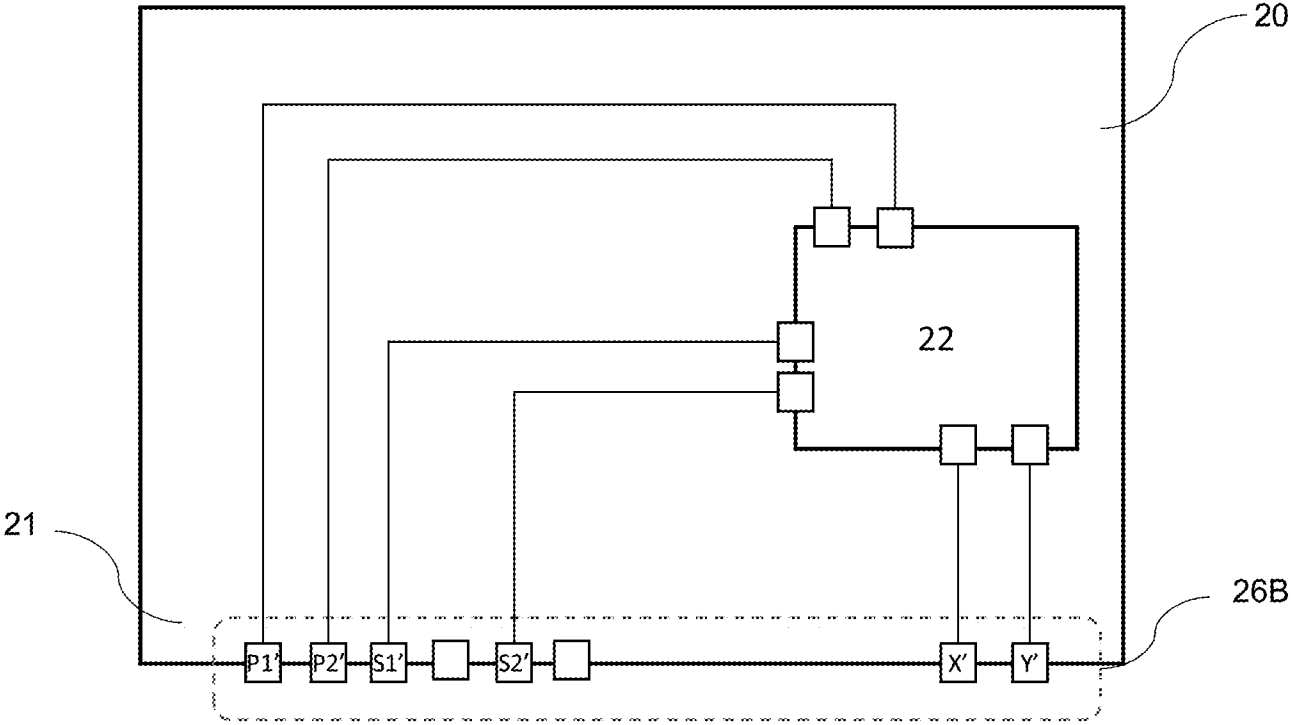
FIG. 2: a highly schematic block diagram of an embodiment of the add-on HVAC device block according to the present disclosure.

FIG. 2 shows a highly schematic block diagram of an embodiment of the add-on HVAC device block 20 according to the present disclosure. The add-on HVAC device block 20 comprises a housing 21; an add-on interface 26B; and an add-on electronic circuit 22 connected with the add-on interface 26B. The add-on HVAC device block 20 is configured to be attached—in particular by stacking (on top of each other or side by side)—to a base HVAC device block 10 according to one of the embodiments disclosed herein. In particular, the add-on interface 26B is arranged on the housing 21 such that it connects with the extension interface 16A of the base HVAC device block 10 when the add-on HVAC device block 20 is attached to the base HVAC device block 10.

The add-on electronic circuit 22 is configured to provide HVAC functionality(s) of a second category. In particular, the add-on electronic circuit 22 provides data signal processing capabilities not supported by the electronic circuit 12 of the base HVAC device block 10.

As it can be seen, the add-on HVAC device block 20 is constructed correspondingly to the base HVAC device block 10, in particular, the add-on interface 26B is constructed as a counterpart of the extension interface 16A of the base HVAC device block 10. According to the embodiment shown on the FIGS. 2 to 6, the add-on interface 26B comprises signal connectors S1', Sn' for the transmission of data signals and power connectors P1', Pn' for the transmission of electrical power. In order to supply it with electricity, the electronic circuit 12 is connected with the power connectors P1, Pn of the add-on interface 26B.

In the particular embodiments shown of the figures, the add-on interface 26B further comprises further signal connectors X', Y' for routing data signals (between the external electrical interface 18 of the base HVAC device block 10 and the electronic circuit 12 thereof) via the electronic circuit 22 of an add-on HVAC device block 20. The second configuration shall be described below with reference to FIGS. 4 and 5.

Figure 3:
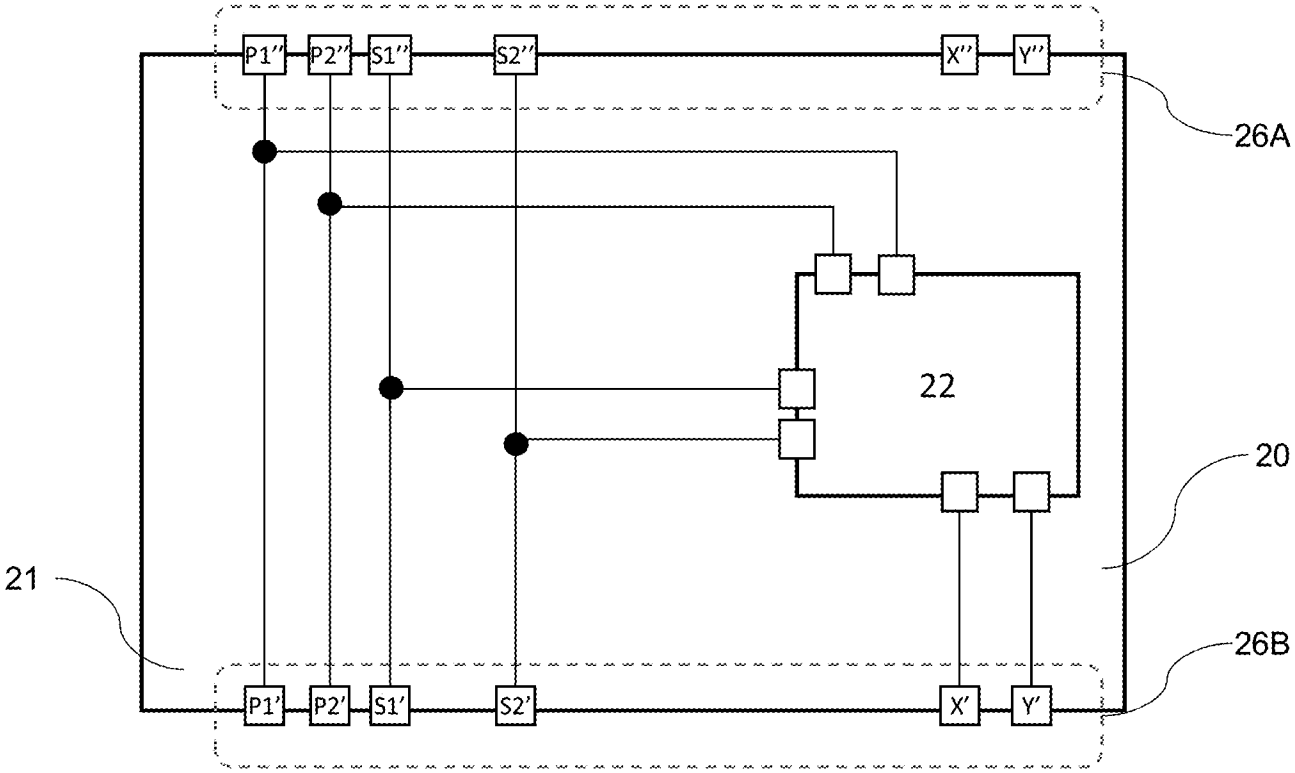
FIG. 3: a highly schematic block diagram of a further embodiment of the add-on HVAC device block according to the present disclosure, configured to receive further add-on HVAC device block(s)

In order to enable the extension of the HVAC functionalities of a base HVAC device block 10 by HVAC functionalities of more than one add-on HVAC device blocks 20, as shown on FIG. 3, according to embodiments disclosed herein, the add-on HVAC device block 20 further comprises a second add-on interface 26A arranged on the housing 21, in particular on a side of the housing 21 opposite the side where the add-on interface 26B is arranged. The second add-on interface 26A is connected with the add-on interface 26B for the transmission of electrical power and data signal(s), wherein the second add-on interface 26A is configured to be able to receive one or more further add-on HVAC device block(s) 20. According to embodiments of the present disclosure, the second add-on interface 26A is constructed identical to the extension interface 16A of the base HVAC device block 10. The second add-on interface 26A comprises signal connectors S1", Sn" for the transmission of data signals and power connectors P1", Pn" for the transmission of electrical power.

Figure 4:
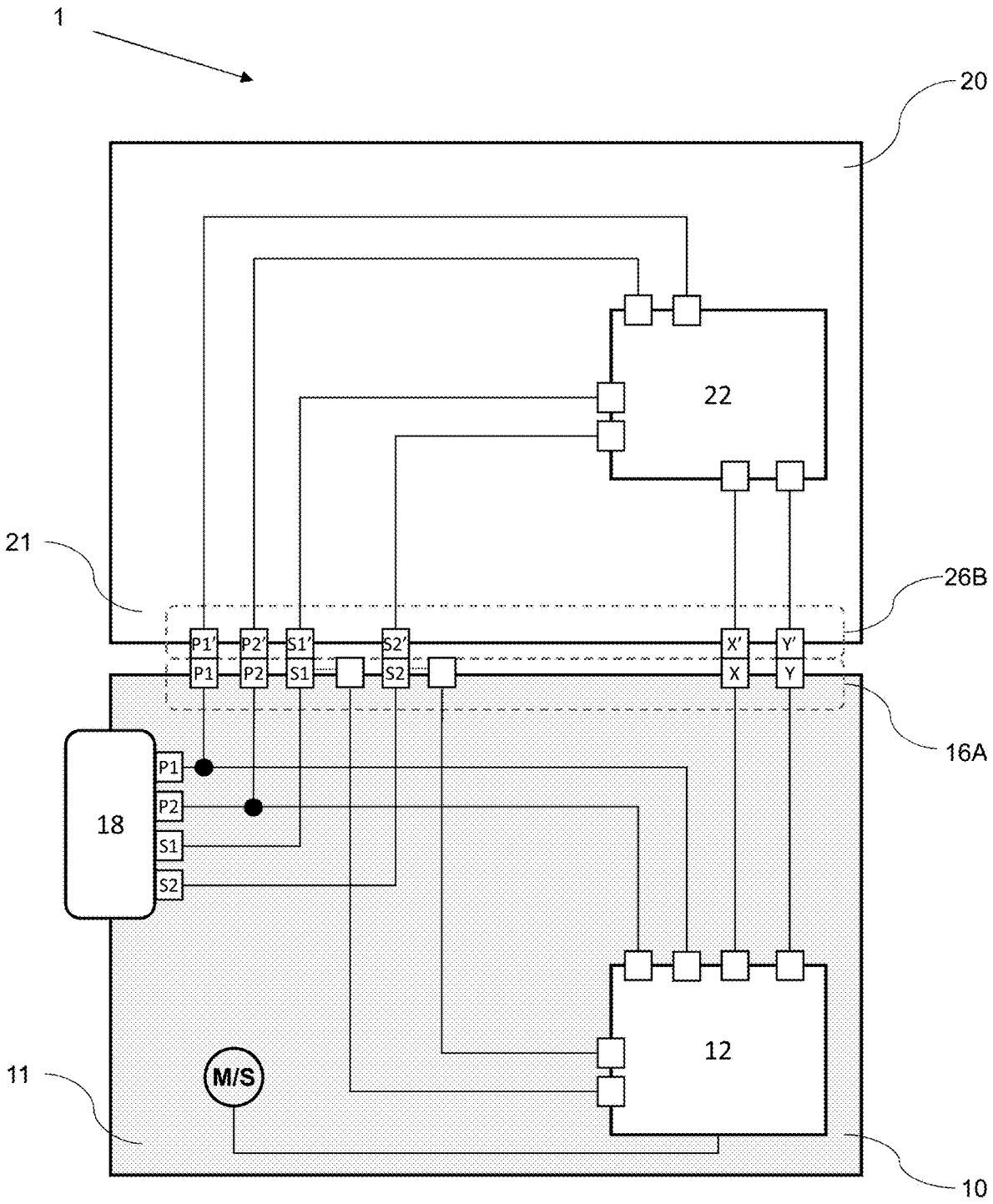
FIG. 4: a highly schematic block diagram of an embodiment of the HVAC field device according to the present disclosure; assembled by stacking an add-on HVAC device block and a base HVAC device block.

Turning now to FIG. 4, a HVAC field device a according to the present disclosure shall be described. As illustrated, the HVAC field device a is assembled by stacking an add-on HVAC device block 20 and a base HVAC device block 10, such that the add-on interface 26B of the add-on HVAC device block 20 is connected with the extension interface 16A of the base HVAC device block 10 for transmission of electrical power and data signal(s).

FIG. 4 illustrates the operation of the base HVAC device block 10, and thereby of the entire HVAC field device a, in the second configuration, wherein the data signal(s) received/sent through the external electrical interface 18 are processed by the add-on HVAC device block 20 attached to the base HVAC device block 10, in particular by an electronic circuit 22 thereof. For this purpose, in the second configuration, the HVAC device block 10 is configured to connect the external electrical interface 18 with the electronic circuit 12 of the base HVAC device block 10 for transmission of data signal(s) through an add-on electronic circuit 22 of an add-on HVAC device block 20 attached to the base HVAC device block 10.

The routing of the data signal(s) through the add-on electronic circuit 22 of the add-on HVAC device block 20 is accomplished via an add-on interface 26B of the add-on HVAC device block 20, corresponding to and connected to the extension interface 16A of the base HVAC device block 10. As shown on FIG. 4, when the add-on HVAC device block 20 is stacked onto the base HVAC device block 10, the signal connectors S1, Sn, the power connectors P1, Pn and the further signal connectors X, Y of the extension interface 16A are connected to the signal connectors S1', Sn', the power connectors P1', Pn' and the further signal connectors X', Y' of the add-on interface 26B, respectively.

Figure 5:
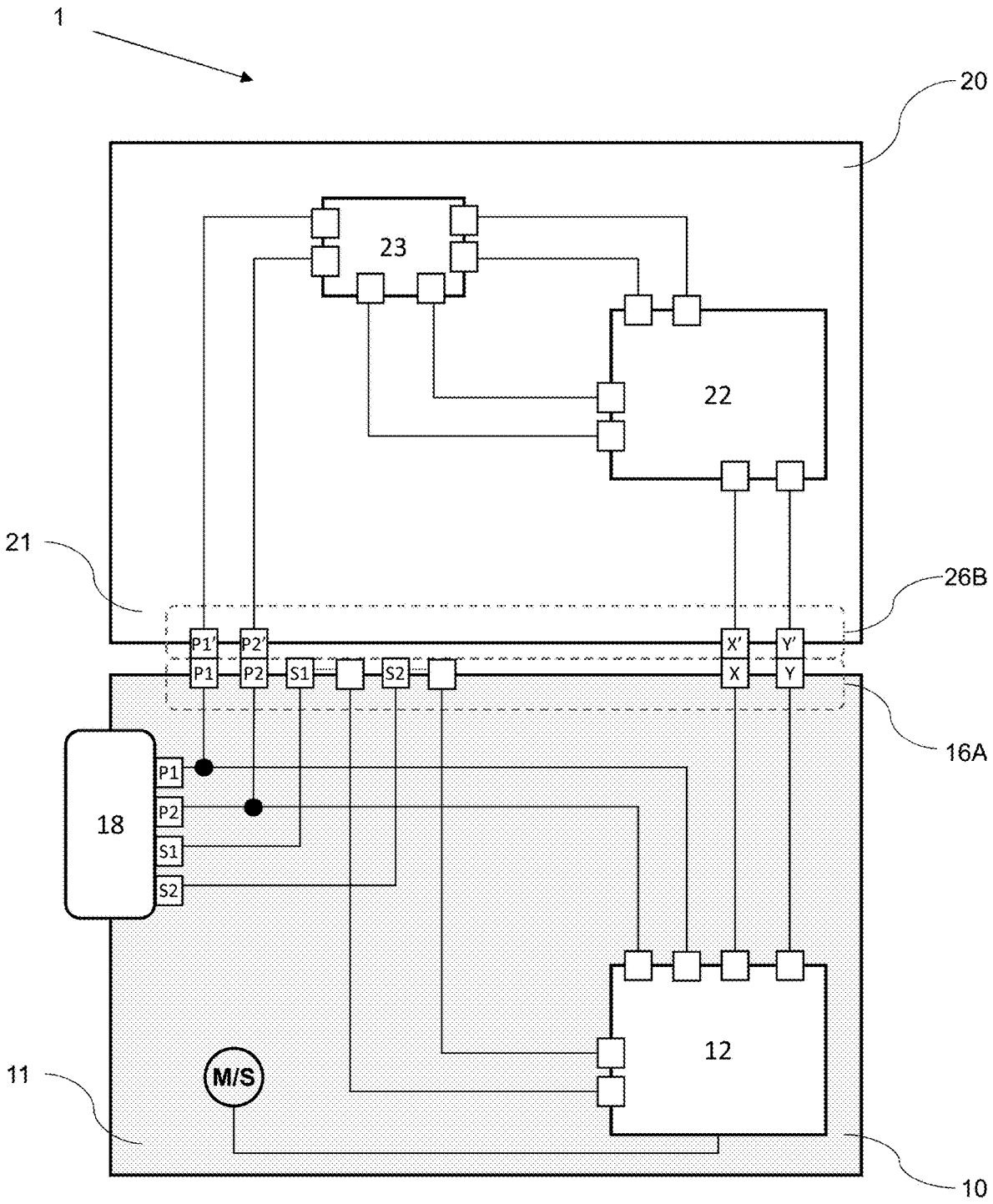
FIG. 5: a highly schematic block diagram of a further embodiment of the HVAC field device according to the present disclosure; configured for Power-Line Communication.

FIG. 5 shows a highly schematic block diagram of a further embodiment of the HVAC field device 1 according to the present disclosure, wherein the add-on HVAC device block 20 extends the functionality of the base HVAC device block 10 with the capability of Power-Line Communication. In order to add Power Line Communication capabilities, the add-on HVAC device block 20 comprises a power supply unit 23. The power supply unit 23 is provided to "separate" transfer of data signal(s) from transfer of electrical power. On one hand, the power supply unit 23 transfers data signal(s) between power connectors P1', Pn' of the add-on interface 26B and signal connectors of the add-on electronic circuit 22. On the other hand, the power supply unit 23 transfers electric power from the same power connectors P1', Pn' of the add-on interface 26B to power connectors of the add-on electronic circuit 22. The transfer of data signal(s) between power connectors P1', Pn' of the add-on interface 26B and signal connectors of the add-on electronic circuit 22 by the power supply unit 23 comprises demodulation of data signal(s) carried by power-line connections/modulation of data signal(s) to be then carried by power-line connections. The data signals being modulated/demodulated by the power supply unit 23 of the add-on HVAC device block 20, the HVAC device blocks (both base and add-on) can provide the respective HVAC functionalities as if the transmission of data signal(s) and transmission of electrical power would be on separate power and signal connections. Signal connectors S1, Sn are (illustrated in the figures with fine dotted lines), are only in use of the base HVAC device block 10 is operated in the first configuration, i.e. by itself without Power-Line Communication support.

Figure 6:
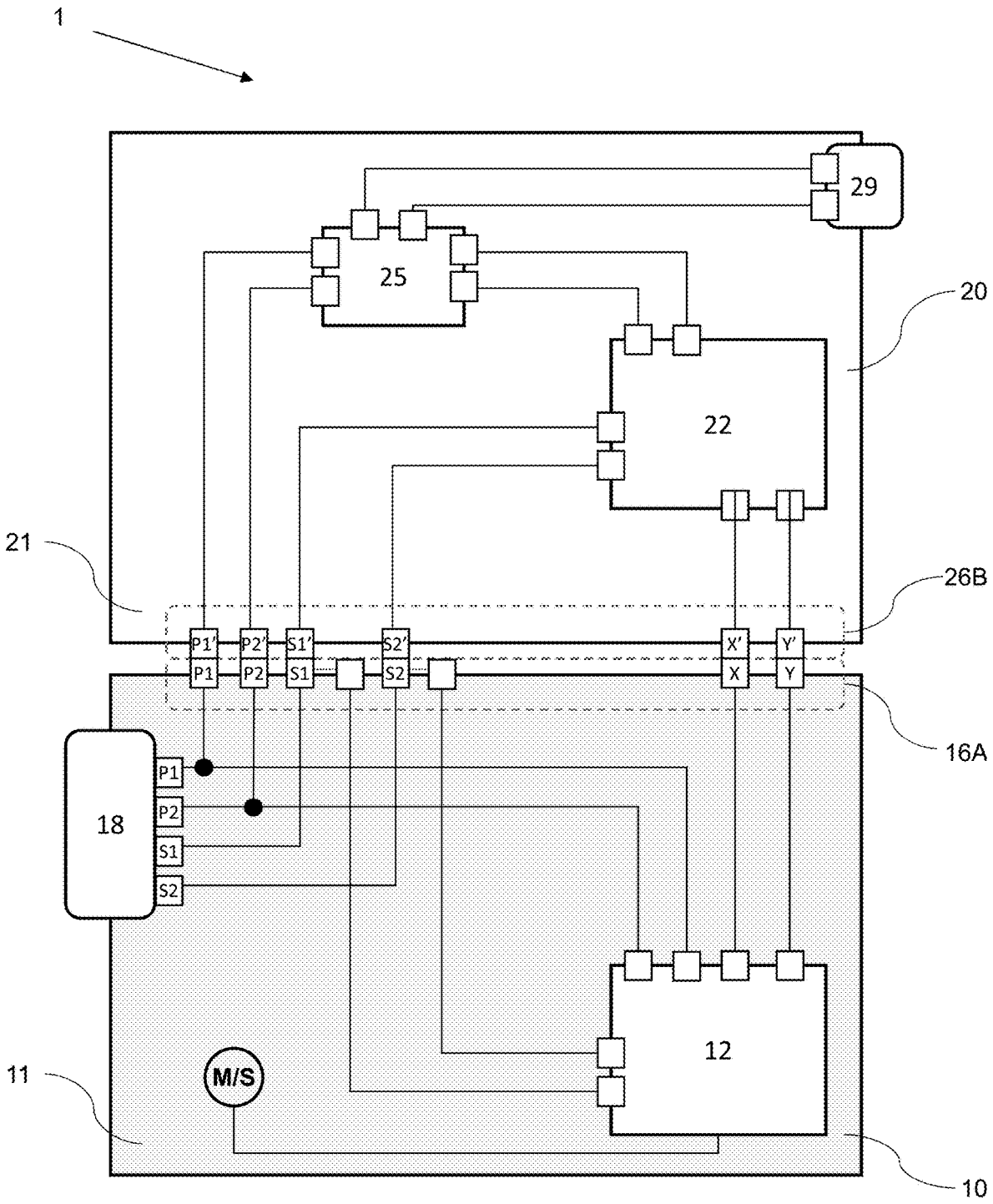
FIG. 6: a highly schematic block diagram of a further embodiment of the HVAC field device according to the present disclosure; configured for being powered though an AC connection of an add-on HVAC device block.

FIG. 6 shows a highly schematic block diagram of a further embodiment of the HVAC field device 1 according to the present disclosure, wherein the add-on HVAC device block 20 extends the functionality of the base HVAC device block 10 with the capability of being powered via the add-on HVAC device block 20, in particular by an AC power supply, such as mains power supply of 230V. In order to provide this HVAC functionality, the add-on HVAC device block 20 comprises an AC power interface 29 for connecting an AC power supply, such as a 230V power supply connected to an AC/DC converter 25. The AC/DC power converter 25 of the add-on HVAC device block 20 is configured to convert the AC power supplied through the AC power interface 29 to a low voltage DC power (such as 24V) and provide such low voltage DC power to the HVAC device blocks 10, 20, in particular to the electric circuit 12 of the base HVAC device block 10 and the electronic circuit 22 of the add-on HVAC device block 20. Such embodiment is advantageous since the other HVAC device blocks (other than the add-on HVAC device block having the AC interface power 29) do not have to be provided with the protective measures required for AC power supply (such as more robust wiring and/or insulation).

Figure 7:
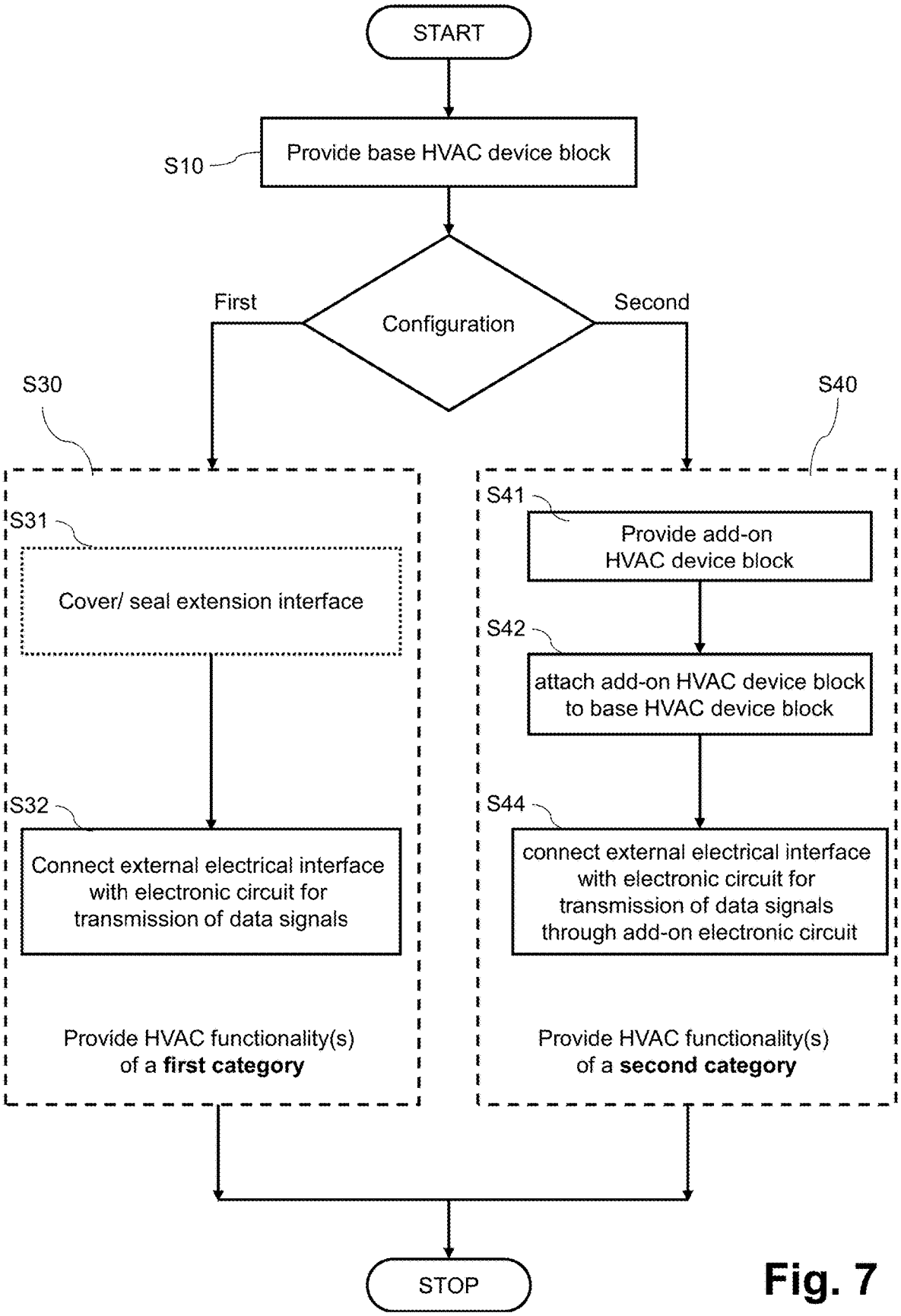
FIG. 7: a flow chart depicting steps of a method of operating a base HVAC device block according to the present disclosure.

Steps of an embodiment of the method of operating a base HVAC device block 10 according to the present disclosure shall be described with reference to FIG. 7. In a preparatory step S10, a base HVAC device block 10, according to one of the embodiments disclosed herein, is provided, wherein the external electrical interface 18 is connected with the electronic circuit 12 and with the extension interface 16A for transmission of electrical power while the extension interface 16A is connected with the external electrical interface 18 for transmission of data signal(s).

In a step S30 of the method of operating a base HVAC device block 10, HVAC functionality(s) of a first category is provided using the HVAC functional device M/S of the base HVAC device block 10, by operating the base HVAC device block 10 in a first configuration. In a substep S32 of operating the base HVAC device block 10 in a first configuration, the external electrical interface 18 is connected with the electronic circuit 12 for transmission of data signal(s).

In a step S40 of the method of operating a base HVAC device block 10, HVAC functionality(s) of a second category is provided using the HVAC functional device M/S by operating the base HVAC device block 10 in a second configuration. In a preparatory step S41, of operating the base HVAC device block 10 in the second configuration, an add-on HVAC device block 20, according to one of the embodiments disclosed herein, is provided. In a further preparatory substep 42 of operating the base HVAC device block 10 in the second configuration, an add-on HVAC device block 20 is attached to the base HVAC device block 10 so that an add-on interface 26B of the add-on HVAC device block 20 is connected with the extension interface 16A of the base HVAC device block 10 for transmission of electrical power and data signal(s). In a step S44 of operating the base HVAC device block 10 in the second configuration, the external electrical interface 18 is connected with the electronic circuit 12 for transmission of data signal(s) through the add-on electronic circuit 22 of the add-on HVAC device block 20, via the extension interface 16A and the add-on interface 26B. By re-routing data signals between the external electrical interface 18 and the electronic circuit 12 of the base HVAC device block 10 through the add-on electronic circuit 22 of the add-on HVAC device block 20, the add-on electronic circuit 22 extends the HVAC functionalities of the base HVAC device block 10 with HVAC functionality(s) of second category.

Illustrated with fine dotted lines, in an optional preparatory step S31, the extension interface 16A is sealed and/or covered, for example by a cover. The cover may be a mere passive mechanical cover element to protect the extension interface 16A from dust, moisture, etc. In order to cover the extension interface 16A, the cover HVAC device block is stacked thereon, thereby mechanically connecting the extension interface of the base HVAC device block 10 with the add-on interface of the cover HVAC block.

According to further embodiments, the cover is provided in the form of a cover HVAC device block, comprising a housing; an add-on interface and a human interaction device HID arranged to control and/or display operational parameters of the HVAC field device 1 (or one or more of its constituent HVAC device blocks 10, 20) and/or one or more of the operational parameters of the HVAC system 100 measured by the sensor S.

Figure 8:
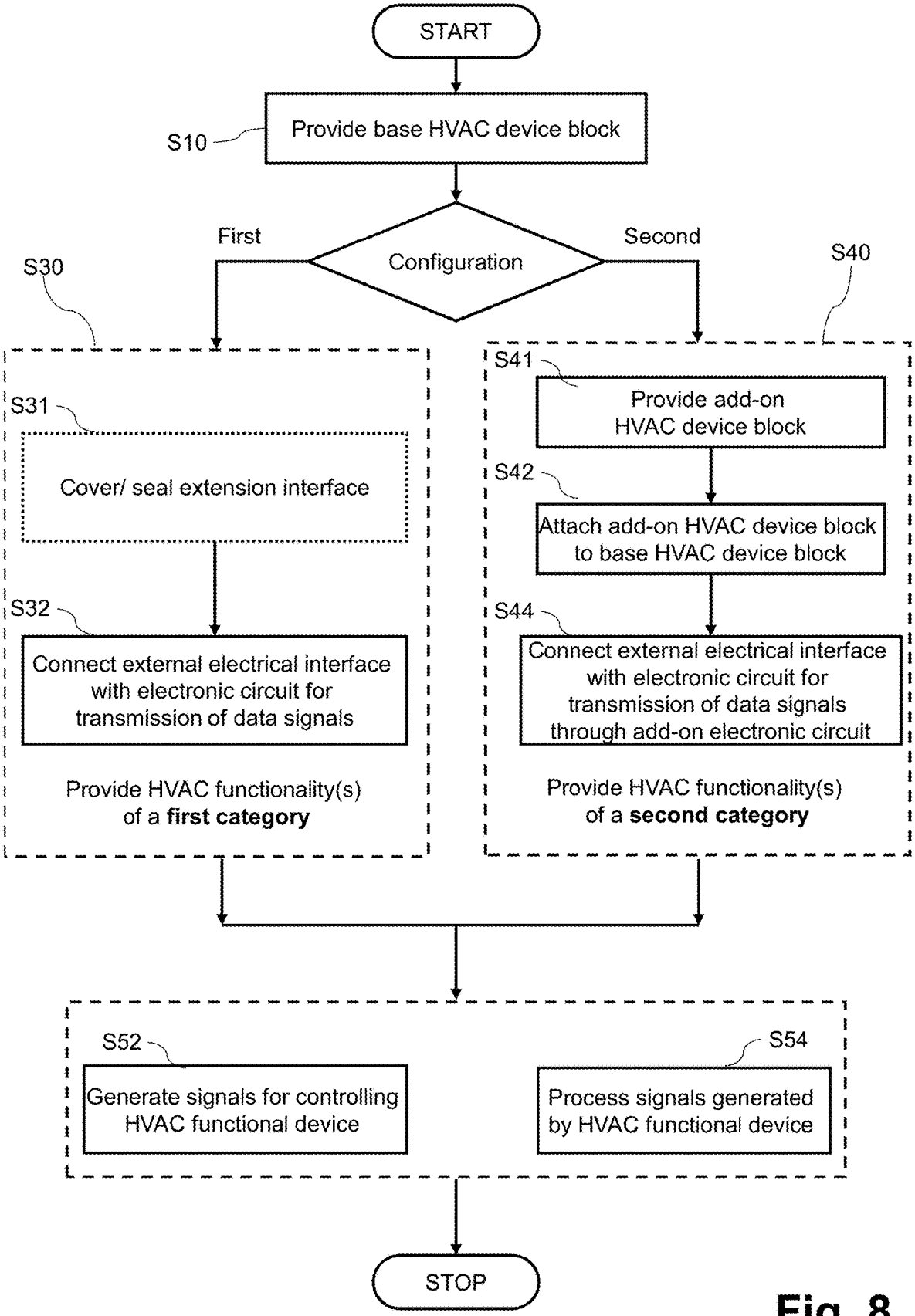
FIG. 8: a flow chart depicting steps of a further embodiment of the method of operating a base HVAC device block according to the present disclosure.

FIG. 8 shows a flow chart illustrating further details of the method of operating a base HVAC device block 10 according to the present disclosure. In a step S52, providing HVAC functionality by the electronic circuit 12 and/or by the add-on electronic circuit 22 comprises generating signal(s)

for controlling the HVAC functional device M/S. Alternatively, or additionally, in a step S54, providing HVAC functionality by the electronic circuit 12 and/or by the add-on electronic circuit 22 comprises processing signals generated by the HVAC functional device M/S.

According to further embodiments, in addition to generating and processing of signals for controlling respectively generated by the HVAC functional device M/S, additional data are processed and/or generated by the electronic circuit 12 of the base HVAC device block 10 or the electronic circuit 22 of the add-on HVAC device block 20, such as configuration data, operational data, etc.

Figure 9:
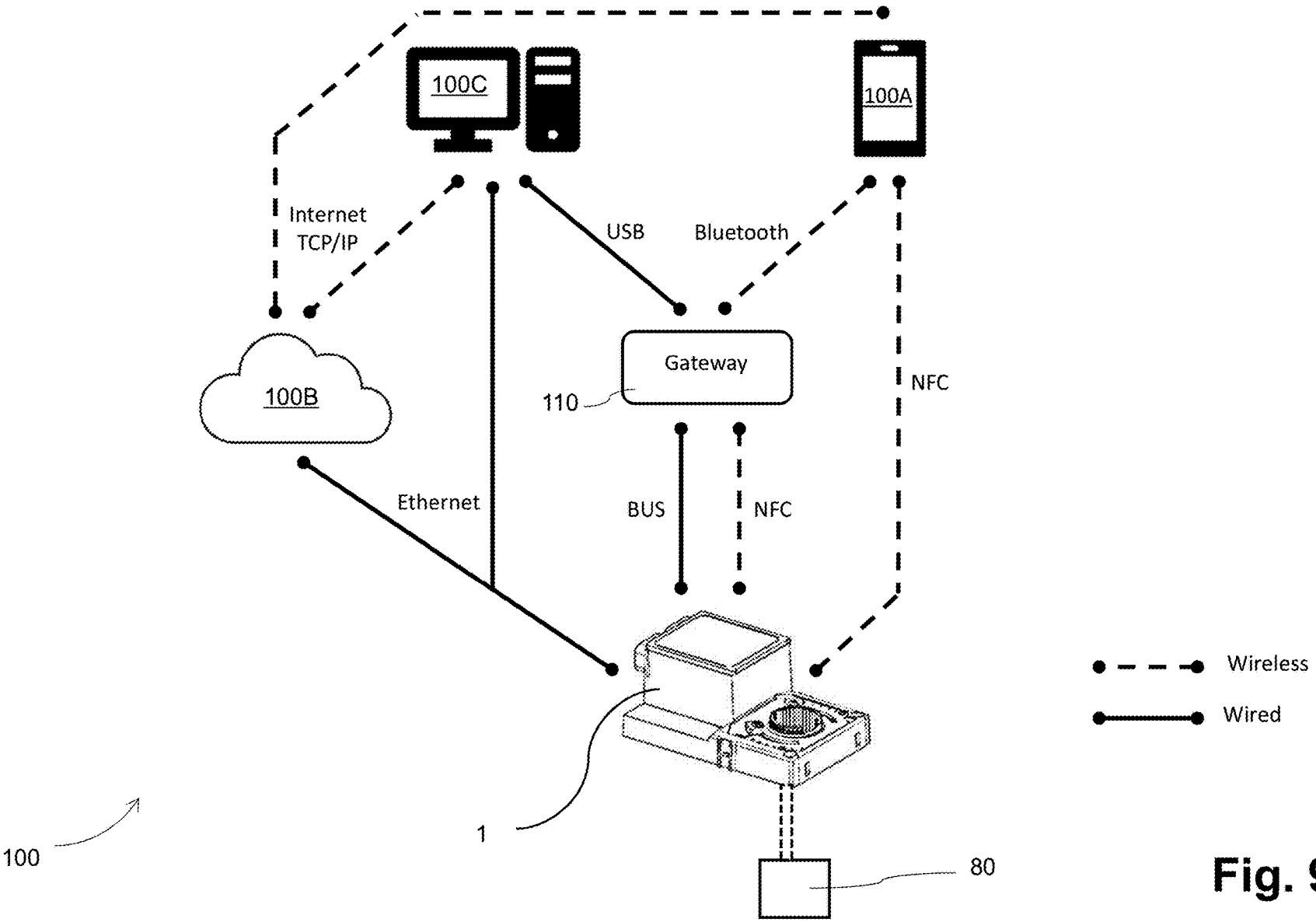
FIG. 9: a schematic block diagram of an HVAC system, comprising an HVAC field device according to the present disclosure.

Turning now to FIG. 9, an HVAC system 100 shall be described, comprising an HVAC field device a according to the present disclosure. The HVAC system 100 comprises one or more external computing devices 100A-C, such as a remote server 100B communicatively connected with the HVAC field device 1 using a radio communication circuit of one or more of the add-on HVAC device block(s) 20. Additionally, or alternatively, the HVAC field device 1 is configured to establish a communication link with a mobile computing device 100A using radio communication circuits of one or more of the add-on HVAC device block(s) 20, in particular a Near Field Communication NFC and/or a Bluetooth Low Energy BLE and/or a Wireless Local Area Network WLAN communication circuit. The HVAC field device 1 is further connectable (using communication circuits and/or the external electrical interface 18 or through one or more of the add-on HVAC device block(s) 20 to a control terminal 100C, such as a computer running a Building Management System BMS, either directly or via a gateway device 110 using a wired (such as a BUS connection) or a wireless connection (such as NFC). Connecting the HVAC field device 1 to one more external computing devices 100A-C, is achieved in particular by operating the base HVAC device block 10 in the second configuration, whereby one or more add-on HVAC device block(s) 20 provide the HVAC functionalities of connecting said one more external computing devices 100A-C. According to a particular embodiment, the gateway device 110 is comprised by an add-on HVAC device block 20.

LIST OF REFERENCE NUMERALS

HVAC field device 1
HVAC device blocks 10, 20
base HVAC device block 10
electronic circuit 12
extension interface 16A
external electrical interface (of base HVAC device block) 18
electric motor (of base HVAC device block) M
sensor (of base HVAC device block) S
signal connectors (of base HVAC device block) S1, Sn
power connectors (of base HVAC device block) P1, Pn
further signal connectors (of base HVAC device block) X, Y
add-on HVAC device block 20
housing (of add-on HVAC device block) 21
add-on electronic circuit (of add-on HVAC device block) 22
power supply unit 23
power converter 25
an add-on interface 26B
second add-on interface 26A
power interface 29
signal connectors (of add-on HVAC device block) S1', Sn', S1", Sn"
power connectors (of add-on HVAC device block) P1', Pn', P1", Pn"
further signal connectors (of add-on HVAC device block) X', Y', X", Y"
actuated part 80
HVAC system 100
external computing devices 100A-C
mobile computing device 100A
remote server 100B
control terminal 100C
gateway device 110

The invention claimed is:

1. A base heating, ventilation, and air conditioning (HVAC) device block comprising:
a housing;
an HVAC functional device;
an extension interface arranged on the housing;
an external electrical interface arranged on the housing for the transmission of electrical power and data signal(s); and
an electronic circuit connected with the HVAC functional device configured to provide HVAC functionality(s) of a first category,
wherein:
the external electrical interface is connected with the electronic circuit and with the extension interface for the transmission of electrical power;
the extension interface is connected with the external electrical interface for transmission of data signal(s);
the base HVAC device block is configured:
in a first configuration, to connect the external electrical interface with the electronic circuit for transmission of data signal(s); and
in a second configuration, to connect the external electrical interface with the electronic circuit for transmission of data signal(s) through an add-on electronic circuit of an add-on HVAC device block attached to the base HVAC device block via an add- on interface of the add-on HVAC device block, wherein the add-on electronic circuit is configured to provide HVAC functionality(s) of a second category comprising at least one HVAC functionality not comprised by the HVAC functionality of the first category; and
wherein the HVAC functionality(s) of the first category and the HVAC functionality(s) of the second category comprise generating one or more signals for controlling the HVAC functional device and/or processing signals generated by the HVAC functional device.

2. The base HVAC device block according to claim 1, wherein providing the HVAC functionality of the first category- by the electronic circuit and/or providing the HVAC functionality of the second category by the add-on electronic circuit comprises:
generating signal(s) for controlling the HVAC functional device and/or
processing signals generated by the HVAC functional device.

3. The base HVAC device block according to claim 2, wherein the HVAC functionality of the first category is provided using computer readable instructions executable by a processor of the electronic circuit and/or the HVAC functionality of the second category is provided using computer readable instructions executable by a processor of the add-on electronic circuit.

4. The base HVAC device block according to claim 1, wherein:

the external electrical interface and the extension interface comprise signal connector(s) for the transmission of data signals and power connector(s) for the transmission of electrical power;

the electronic circuit and the power connector(s) of the extension interface are connected with the power connector(s) of the external electrical interface for transmission of electrical power; and the electronic circuit and the signal connector(s) of the extension interface are connected with the signal connector(s) of the external electrical interface for the transmission of data signal(s).

5. The base HVAC device block according to claim 1, wherein the HVAC functional device comprises an electric motor arranged within the housing to drive an actuated part and/or a sensor configured to measure a parameter of an HVAC system.

6. The base HVAC device block according to claim 1, further comprising a switching device for switching between the first configuration and the second configuration.

7. The base HVAC device block according to claim 6, wherein the switching device is configured to switch the base HVAC device block into the second configuration upon an add-on HVAC device block being attached to the base HVAC device block and/or to switch the HVAC device block into the first configuration upon an add- on HVAC device block being detached from the base HVAC device block.

8. An add-on heating, ventilation, and air conditioning (HVAC) device block comprising:

a housing;

an add-on interface arranged on the housing; and an add-on electronic circuit connected with the add-on interface, wherein, the add-on HVAC device block is configured, when attached to a base HVAC device block:

to connect an external electrical interface with an electronic circuit of the base HVAC device block for transmission of data signal(s) through the add-on electronic circuit, via the add-on interface and an extension interface of the base HVAC device block;

to provide, using the add-on electronic circuit, HVAC functionality(s) of a second category to the base HVAC device block comprising at least one HVAC functionality not comprised by the HVAC functionality of a first category provided by the electronic circuit of the base HVAC device block:

by generating signal(s) for controlling an HVAC functional device and/or by processing signals generated by the HVAC functional device, wherein the HVAC functionality(s) of the first category and the HVAC functionality(s) of the second category comprise generating one or more signals for controlling the HVAC functional device and/or processing signals generated by the HVAC functional device.

9. The add-on HVAC device block according to claim 8, wherein the add-on electronic circuit is connected with the add-on interface for the transmission of electrical power.

10. The add-on HVAC device block according to claim 8, wherein HVAC functionality is provided using computer readable instructions executable by a processor of the add-on electronic circuit and/or the electronic circuit attached to the add-on HVAC device block.

11. The add-on HVAC device block according claim 8, further comprising a second add-on interface arranged on the housing, the second add-on interface being connected with the add-on interface for the transmission of electrical power and data signal(s), wherein the second add-on interface is configured to be able to receive one or more further add-on HVAC device block(s).

12. The add-on HVAC device block according to claim 8, further comprising an add-on external electrical interface arranged on the housing for the transmission of electrical power and data signal(s), the add-on external electrical interface being connected to the add-on electronic circuit.

13. The add-on HVAC device block according to claim 8, wherein the add-on interface is configured for transmission of data signal(s) and transmission of electrical power over same electrical connections, the add-on HVAC device block further comprising a power supply unit configured to:

transfer data signal(s) between the add-on interface and the add-on electronic circuit;

transfer electrical power from the add-on interface to the add-on electronic circuit.

14. The add-on HVAC device block according to claim 8, further comprising a power interface and a power converter configured to provide electrical power supplied through the power interface for the electric circuit of the base HVAC device block and/or the electronic circuit of the add-on HVAC device block.

15. An HVAC field device comprising:

a base HVAC device block comprising:

a housing;

an HVAC functional device;

an extension interface arranged on the housing;

an external electrical interface arranged on the housing for the transmission of electrical power and data signal(s); and an electronic circuit connected with the HVAC functional device configured to provide HVAC functionality(s) of a first category, and an add-on HVAC device block according to claim 8 attached to the base HVAC device block, wherein:

the external electrical interface is connected with the electronic circuit and with the extension interface for transmission of the electrical power;

the extension interface is connected with the external electrical interface for transmission of the data signal(s);

the base HVAC device block is configured:

in a first configuration, to connect the external electrical interface with the electronic circuit for transmission of the data signal(s); and in a second configuration, to connect the external electrical interface with the electronic circuit for transmission of the data signal(s) through an add-on electronic circuit of the add-on HVAC device block attached to the base HVAC device block via an add-on interface of the add-on HVAC device block, wherein the add-on electronic circuit is configured to provide HVAC functionality(s) of a second category comprising at least one HVAC functionality not comprised by the HVAC functionality of the first category; and wherein the HVAC functionality(s) of the first category and the HVAC functionality(s) of the second category comprise generating one or more signals for controlling the HVAC functional device and/or processing signals generated by the HVAC functional device.

16. A method of operating a base heating, ventilation, and air conditioning (HVAC) device block comprising:

an HVAC functional device;

an extension interface arranged on the housing;

an external electrical interface arranged on the housing for the transmission of electrical power and data signal(s); and an electronic circuit connected with the HVAC functional device configured to provide HVAC functionality(s) of a first category, wherein:

the external electrical interface is connected with the electronic circuit and with the extension interface for the transmission of electrical power; and the extension interface is connected with the external electrical interface for transmission of the data signal(s), the method comprising the steps of:

providing HVAC functionality(s) of the first category using the HVAC functional device by operating the base HVAC device block in a first configuration comprising connecting the external electrical interface with the electronic circuit for transmission of the data signal(s); and providing HVAC functionality(s) of a second category using the HVAC functional device by operating the base HVAC device block in a second configuration comprising:

attaching an add-on HVAC device block to the base HVAC device block so that an add-on interface of the add-on HVAC device block is connected with the extension interface of the base HVAC device block for transmission of the electrical power and data signal(s), the add-on HVAC device block comprising an add-on electronic circuit connected with the add-on interface and configured to provide HVAC functionality(s) of thea second category; comprising at least one HVAC functionality not comprised by the HVAC functionality of the first category; and connecting the external electrical interface with the electronic circuit for the transmission of data signal(s) through the add-on electronic circuit of the add-on HVAC device block, via the extension interface and the add-on interface, wherein the HVAC functionality(s) of the first category and the HVAC functionality(s) of the second category comprise generating one or more signals for controlling the HVAC functional device and/or processing signals generated by the HVAC functional device.

17. The method of operating the base HVAC device block according to claim 16, wherein providing HVAC functionality-by the electronic circuit and/or by the add-on electronic circuit comprises:

generating signal(s) for controlling the HVAC functional device and/or processing signals generated by the HVAC functional device.

18. The method of operating the base HVAC device block according to claim 16, wherein HVAC functionality is provided by executing computer readable instructions by a processor of the electronic circuit of the base HVAC device block and/or of the add-on electronic circuit of the add-on HVAC device block attached to the base HVAC device block.

19. The method of operating the base HVAC device block according to claim 16, further comprising:

connecting the electronic circuit and power connector(s) of the extension interface with power connector(s) of the external electrical interface for transmission of electrical power; and connecting the electronic circuit and signal connector(s) of the extension interface with signal connector(s) of the external electrical interface for the transmission of data signal(s).

20. The method of operating the base HVAC device block according to claim 16, further comprising switching, using a switching device, the base HVAC device block into the second configuration upon an add-on HVAC device block being attached to the base HVAC device block and/or into the first configuration upon an add-on HVAC device block being detached from the base HVAC device block.

21. The method of operating athe base HVAC device block according to claim 16, further comprising:

driving an actuated part using an electric motor of the HVAC functional device arranged within the housing according to signal(s) generated by the electronic circuit of the base HVAC device block and/or by the add-on electronic circuit of the add-on HVAC device block attached to the base HVAC device block and/or processing, by the electronic circuit of the base HVAC device block and/or by the add-on electronic circuit of the add-on HVAC device block attached to the base HVAC device block, signal(s) indicative of a parameter of an HVAC system measured by a sensor(S) of the HVAC functional device.

* * * * *